United States Patent [19]

Nishida

[11] Patent Number: 4,700,650

[45] Date of Patent: Oct. 20, 1987

[54] BOAT WITH APPARATUS FOR RETURNING TO UPRIGHT CONDITION

[75] Inventor: Hiroshi Nishida, Miki, Japan

[73] Assignee: Kawasaki Jukogyo Kabushiki Kaisha, Kobe, Japan

[21] Appl. No.: 760,287

[22] Filed: Jul. 29, 1985

[30] Foreign Application Priority Data

Jul. 31, 1984 [JP] Japan ..... 59-161329

[51] Int. Cl.[4] ..... B63B 39/03

[52] U.S. Cl. ..... 114/125; 114/74 A

[58] Field of Search ..... 114/68, 69, 38, 121, 114/122, 125, 333, 347, 348, 349, 270, 73, 182–185, 26

[56] References Cited

U.S. PATENT DOCUMENTS 132,695 5/1943 Hort ..... 114/125

2,727,254 12/1955 Johnson ..... 114/349

4,346,664 8/1982 Enzian, Jr. ..... 114/349

*Primary Examiner*—Joseph F. Peters, Jr.

*Assistant Examiner*—Jesûs D. Sotelo

*Attorney, Agent, or Firm*—Marshall, O'Toole, Gerstein, Murray & Bicknell

[57] ABSTRACT

This disclosure relates to an arrangement for returning a small boat from an overturned position to a normal upright position. The boat comprises a substantially enclosed room and a partition provided in the room adjacent the bottom of the craft to form in the room an upper compartment and a lower compartment under the upper compartment. The lower compartment is adapted to contain water, and the partition is adapted to substantially prevent the water from entering the upper compartment when the craft is overturned.

4 Claims, 7 Drawing Figures

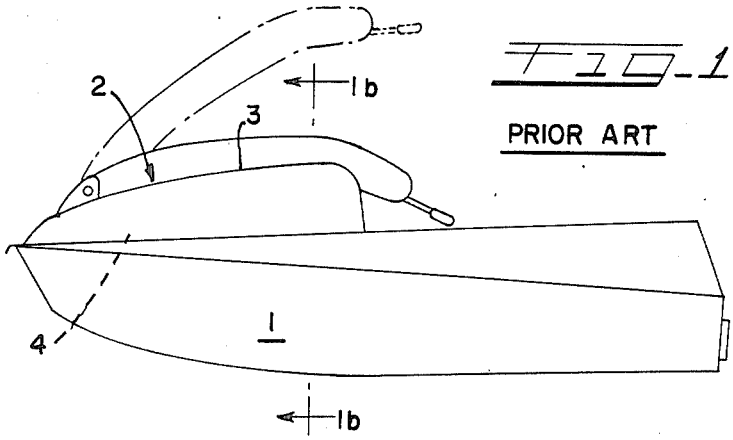
FIG. 1a
PRIOR ART
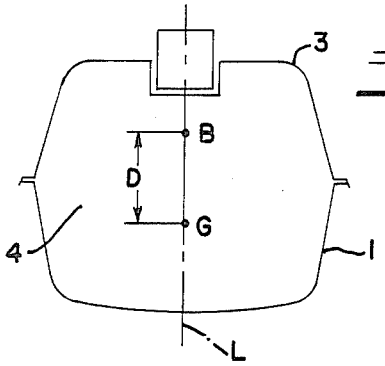
FIG. 1b
PRIOR ART
FIG. 2
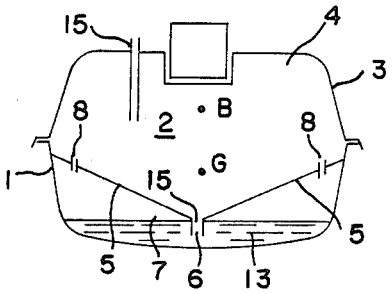
FIG. 3
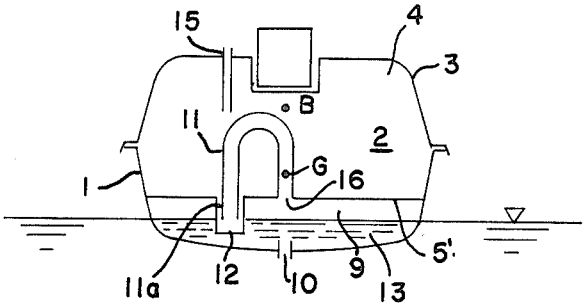

FIG. 4
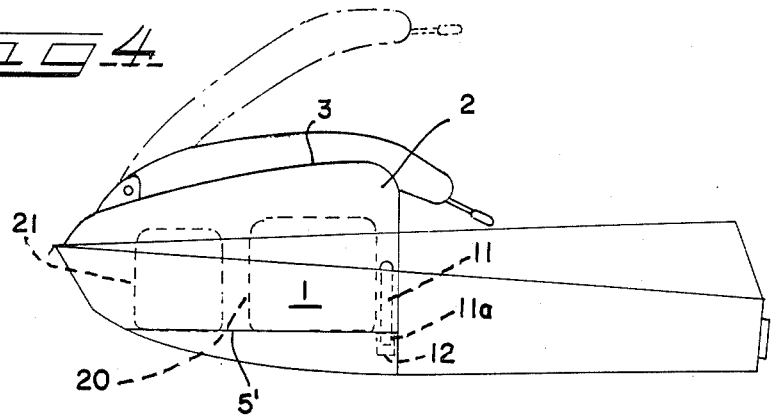
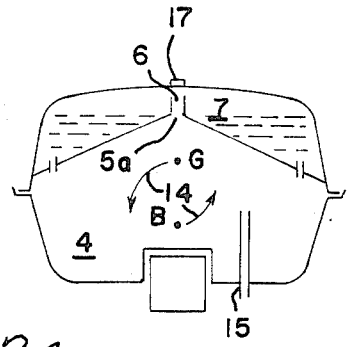
FIG. 2a
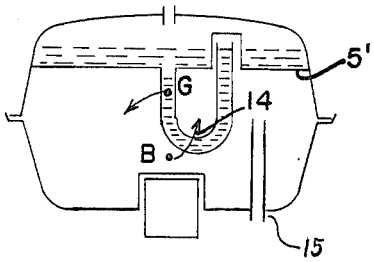
FIG. 3a

BOAT WITH APPARATUS FOR RETURNING TO UPRIGHT CONDITION

FIELD AND BACKGROUND OF THE INVENTION

The present invention relates to a small boat or waterborne vehicle, particularly of the jet propulsion type. This is a recreational type of boat that is designed for use by one person, and it is frequently operated at high speed and in sharp turns, and as a result it often overturns.

As shown in FIGS. 1*a* and 1*b*, a conventional boat of this type includes a hull 1 and an enclosed engine room 4 at the forward end of the boat, which is closed by a cover 3. The engine room thus forms a float or buoyant body adjacent the bow. This float has a center B, see FIG. 1*b*, of buoyancy at a position which is designed to be as high as possible, and the boat has a center G of gravity at a position which is designed to be as low as possible. This arrangement increases the vertical distance D between these centers B and G on the vertical center line L of the boat. As a result, the float makes the bow stand high in the water, with the result that the boat cannot be designed with a streamlined shape. If a weight or ballast is added to the bottom of the boat, as is done with a larger yacht, the total weight is increased so that the boat is difficult to transport, which is an important factor for a small recreational boat.

It is a general object of this invention to provide a small boat which has a low steamlined bow portion and has a low center of buoyancy, but which can automatically return to the normal upright position quickly after it has been overturned.

SUMMARY OF THE INVENTION

A boat according to this invention includes an engine room, which has a compartment formed by a partition located near the bottom of the room. The compartment is partially filled with water and it is shaped to increase the force couple, which is produced by the weight and the buoyancy of the boat when the boat is capsized, in the direction to return the capsized boat to the normal upright position.

BRIEF EXPLANATION OF THE DRAWINGS

The invention will be better understood from the following detailed description of preferred embodiments of the invention taken in conjunction with the accompanying drawings, wherein:

FIG. 1*a* is a side view of a conventional jet propulsion type boat;

FIG. 1*b* is a schematic view of the boat of FIG. 1*a*, taken on the line 1*b*—1*b* of FIG. 1*a;*

FIG. 2 is a schematic view of a jet propulsion type boat according to a first embodiment of the invention, in cross section adjacent the bow;

FIG. 2*a* shows the boat of FIG. 2 in capsized position;

FIG. 3 is a view similar to FIG. 2, but showing the second embodiment of the invention;

FIG. 3*a* shows the boat of FIG. 3 in capsized position;

FIG. 4 is a longitudinal section view of the boat shown in FIG. 3.

DETAILED DESCRIPTION OF THE DRAWINGS

In FIG. 2, the boat includes a relatively wide and low hull 1, and an engine room 2 formed by the hull adjacent the bow. The upper side of the room 2 is closed during operation by a removable cover 3, the closed room 2 thereby forming a float or buoyant body. The boat has another float under the deck (not shown) adjacent the stern.

The room 2 is divided into an upper or main portion 4 and a lower bilge well or compartment 7, by a pair of symmetrical partitions 5 which extend adjacent the bottom of the hull from both side walls of the hull 1 and slant downwardly to the center line of the boat at an angle. The lower edges of the partitions 5 are interconnected by a narrow flat bottom wall formed between the partitions. This bottom wall is formed with small bilge water intake holes 6 therein at intervals which are spaced longitudinally of the boat. The partitions 5 are preferably formed with breathing orifices or holes 8 therein adjacent the upper edges thereof.

An engine and a fuel tank (not shown) are also mounted in the engine room. The partitions 5 extend for the entire length of the engine room, and the engine and the fuel tank are mounted on braces above the partitions and they bridge the valley between the partitions (see FIG. 4 for the general arrangement).

The well 7 contains an amount of bilge water 13 which is normally up to a level which is at or below the intake hole 6, thereby leaving air spaces between the water and the partitions 5. The boat containing the water 13 has a center G of gravity, and the boat has a center B of buoyancy substantially above the gravity center G and the partitions 5.

When the boat is overturned as shown in FIG. 2*a*, the bilge water 13 moves onto the partions 5 above the buoyancy center B, and little falls into the main portion 4 of the engine room. This movement of the bilge water does not substantially change the positions of the centers G and B, if the boat is overturned by an angle of substantially 180°. In this position, the gravity and the buoyancy of the boat produce a force couple 14 in the direction to return the boat to the normal position. Consequently the boat will return to the normal upright condition with little or no effort of the operator.

A small amount of water may enter the engine room 2 through the engine air intake hole 15 in the cover 3 when the boat is onverturned. When the boat is uprighted, this water flows down along the partitions 5, through the bilge intake hole 6 and into the well 7.

When the boat moves in its normal upright position in the water, the bilge water 13 moves in wave-like fashion, producing positive and negative pressures in the upper air space in the bilge well 7. However, these pressures are released through the breathing holes 8, and do not cause any problems.

The well 7 may contain a porous material, such as sponge, which absorbs water to prevent the bilge surface from waving, or baffle plates may be provided, for example.

In the embodiment of FIGS. 3, 3*a* and 4 the boat includes a rather wide and low hull 1 similar to that shown in FIGS. 2 and 2*a*, and an engine room 2 is formed by the hull adjacent the bow. The room 2 is closed by a cover 3 so as to form a float in addition to the float under the deck (not shown).

The room 2 is divided into an upper or main portion 4 and a lower ballast tank or compartment 9 by a partition 5', which in this instance extends horizontally or laterally adjacent the bottom of the boat. This lower compartment 9 has a ballast water hole 10 formed in its bottom wall.

The partition 5' has a cylindrical recess or well 12 extending downwardly into the compartment 9 from the main part of the partition. The partition 5' also has an inverted U-shape pipe 11 which extends upwardly from an opening 16 formed substantially in the center of the partition. The pipe 11 then curves downwardly into the recess 12, and has an opening 11*a* therein.

The size of the ballast compartment 9 and the weight of the boat are predetermined so that, when an operator of a typical or average weight rides the boat, an amount of water 13 enters the compartment 9 through the bottom hole 10 in the hull and occupies the lower portion of the compartment. As shown in FIG. 3, the water 13 level in the boat is substantially equal to the water level outside the boat, and the partition 5' must be located above this water level. When the water enters the compartment 9, the displaced air flows through the pipe 11 and into the compartment 4. The boat containing the water 13 has a center G of gravity, and the boat has a center B of buoyancy sufficiently above the gravity center G and the partition 5'.

When this boat is overturned as shown in FIG. 3*a*, the bottom hole 10 is exposed to the atmosphere. Consequently, most of the water 13 in the compartment 9 moves onto the partition 5', with a portion of this water entering the now U-shaped pipe 11. Some of this water may flow out of the compartment 9 through the hole 10 as the boat is overturning.

The amount of the water 13 in the compartment 9 when the boat is capsized, and the location of the pipe 11, are such that the level of this water is below the end 11*a* of the pipe 11 in the recess 12. Consequently, the water 13 does not enter the engine room 2 through the pipe 11, but the water is positioned substantially above the buoyancy center B.

In the same manner as the first embodiment, the gravity and the buoyancy of the boat produce a force couple 14 in the direction to return the capsized boat to the normal position.

When the boat is returned to its upright position shown in FIG. 3 and the operator rides it, the ballast compartment 9 again fills to the amount of water shown in FIG. 3.

When the boat moves in its normal position in the water, the positive and negative pressures produced in the upper space in the ballast compartment 9 by the movement of the water 13 are released through the pipe 11, which opens into the upper portion 2 of the engine room.

The inverted U-shape pipe 11 or the ballast hole 10 may have a valve (not shown) to control the amount of the water 13 in the compartment 9 to the predetermined value.

In the first embodiment, the compartment 7 has a drain 17 (FIG. 2*a*) normally covered by a removable cap in the bottom wall, which can be opened to discharge the bilge water so as to reduce the weight of the boat when it is to be transported out of the water.

Instead of shaping the lower compartment for the bilge water symmetrically of the boat as shown, the compartment 7 or 9 may otherwise be formed adjacent one side only of the boat, so as to increase the force couple in the direction to return the capsized boat to the upright position, thereby accelerating the return of the boat.

In FIGS. 3, 3*a* and 4, as in FIG. 2, a conventional engine 20 and a fuel tank 21 are mounted on top of the partition 5'.

What is claimed is:

1. A water craft comprising a substantially enclosed room, partition means provided in said room adjacent the bottom of said craft to form in said room an upper compartment and a lower compartment under said upper compartment, said lower compartment being adapted to contain water, and said partition means being adapted to substantially prevent said water from entering said upper compartment when said craft is overturned, said partition means comprising a pair of partitions, each slanting from one lateral side of said craft downwardly to substantially the center of said craft, said partitions being interconnected and forming a longitudinal valley therebetween, and said valley having a bilge hole formed therein through which said compartments communicate with each other.

2. A water craft according to claim 1, wherein at least one of said partitions has a breathing hole therein.

3. A water craft according to claim 1, wherein said bilge hole is located substantially at the center of said craft and at substantially the bottom of said valley, and said bilge hole is normally open.

4. A water craft comprising a substantially enclosed room, partition means provided in said room adjacent the bottom of said craft to form in said room an upper compartment and a lower compartment under said upper compartment, said lower compartment being adapted to contain water, and said partition means being adapted to substantially prevent said water from entering said upper compartment when said craft is overturned, said lower compartment having a ballast water hole in its bottom wall, so that said lower compartment communicates with the outside of said craft, said partition means comprising a laterally extending partition which has a recess extending into said lower compartment, a pipe having one end extending through said partition, said pipe extending into said upper compartment and curving toward said lower compartment, said pipe having its other end opening in said recess.

* * * * *